United States Patent [19]

Kohler

[11] 4,259,614

[45] Mar. 31, 1981

[54] ELECTRONIC BALLAST-INVERTER FOR MULTIPLE FLUORESCENT LAMPS

[76] Inventor: Thomas P. Kohler, 69 Oswego St., Baldwinsville, N.Y. 13207

[21] Appl. No.: 59,218

[22] Filed: Jul. 20, 1979

[51] Int. Cl.[3] ..... H05B 41/29

[52] U.S. Cl. ..... 315/219; 315/187; 315/189; 315/224; 315/244; 315/245; 315/324; 315/DIG. 7; 363/37; 363/133

[58] Field of Search ..... 315/209 R, 219, 224, 315/244, 245, 187–189, 312, 324, DIG. 7; 363/37, 131, 133

[56] References Cited

U.S. PATENT DOCUMENTS

| | | | |
|---|---|---|---|
| 3,710,177 | 1/1973 | Ward | 315/244 X |
| 3,746,921 | 7/1973 | Marshall et al. | 315/DIG. 7 |
| 3,953,768 | 4/1976 | Meredith et al. | 315/DIG. 7 |
| 4,127,798 | 11/1978 | Anderson | 315/209 R |
| 4,158,792 | 6/1979 | Kuroi et al. | 315/DIG. 7 |

*Primary Examiner*—Eugene R. LaRoche

*Attorney, Agent, or Firm*—Hill, Van Santen, Steadman, Chiara & Simpson

[57] ABSTRACT

An electronic ballast-inverter for multiple fluorescent lamps employs a push-pull inverter and a series resonant circuit for driving the lamps. The inverter operates at the resonant frequency of the series resonant circuit. Current in the resonant circuit is limited, for low-load conditions, in response to a sensing voltage which is used to lower the frequency of operation of the inverter, to make the load more reactive.

10 Claims, 1 Drawing Figure

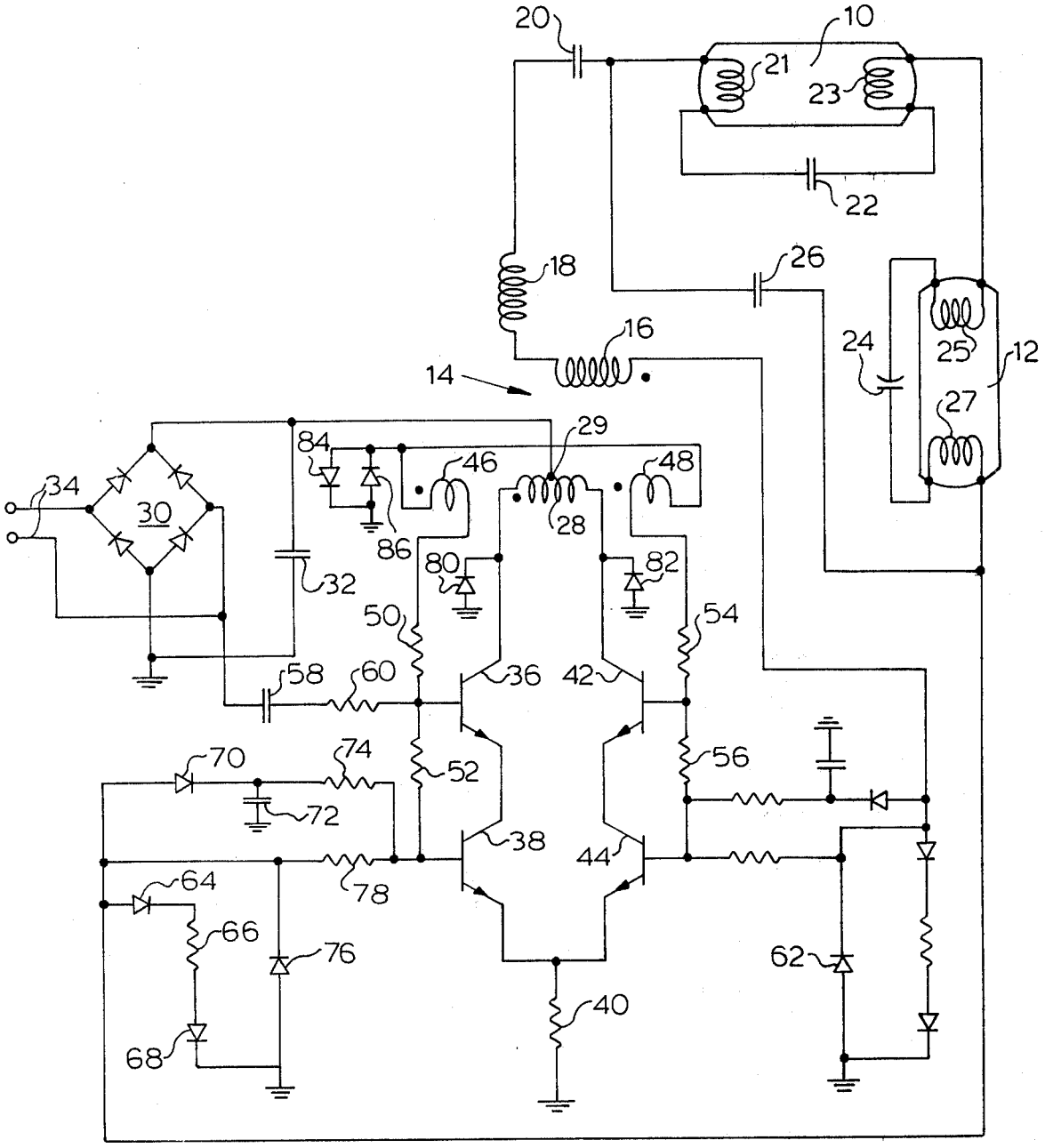
20
10
21
23
22
18
26
16
24
25
12
14
27
29
84
46
48
34
30
28
86
80
82
32
50
54
58
60
36
42
70
74
52
56
72
38
44
64
78
66
76
62
40
68

ELECTRONIC BALLAST-INVERTER FOR MULTIPLE FLUORESCENT LAMPS

BACKGROUND

1. Field of the Invention

The present invention relates to a fluorescent lamp ballast, and more particularly to an electronic ballast-inverter for multiple fluorescent lamps.

2. The Prior Art

A variety of techniques have been employed in the prior art for energizing and exciting multiple fluorescent lamps. While such systems have been generally satisfactory for the purposes for which they were designed, they are characterized by relatively poor efficiency, with a relatively great amount of power being lost in the ballast system. It is accordingly desirable to provide a means for increasing the efficiency of the ballast mechanism for driving multiple fluorescent lamps.

BRIEF SUMMARY OF THE INVENTION

It is a principal object of the present invention to provide a ballast-inverter circuit for driving multiple fluorescent lamps which has a substantially improved efficiency.

Another object of the present invention is to provide a ballast-inverter which is capable of driving multiple fluorescent lamps, without exceeding the maximum limits of the active elements which are employed.

A further object of the present invention is to provide a ballast-inverter for driving multiple fluorescent lamps in which the output current supplied to the lamps is approximately a sine wave.

A further object of the present invention is to provide a ballast-inverter for multiple fluorescent lamps in which production of radio frequency interference or RFI is much reduced.

Another object of the present invention is to provide a ballast-inverter for multiple fluorescent lamps in which the starting voltage and filament power supplied to the lamps is selectable for reliable operation and maximum lamp life.

A further object of the present invention is to provide a ballast-inverter for multiple fluorescent lamps capable of exciting the lamps over an extreme range of line voltage.

BRIEF DESCRIPTION OF THE DRAWING

Reference will now be made to the accompanying drawing, which illustrates a schematic circuit diagram of an illustrative embodiment of the present invention.

DESCRIPTION OF THE PREFERRED EMBODIMENT

Referring now to the drawing, a pair of fluorescent lamps 10 and 12 is illustrated, interconnected with a circuit employing a transformer 14. The secondary winding 16 of the transformer 14 is connected in series with the lamps 10 and 12 through a series inductor 18 and a capacitor 20. Individual capacitors 22 and 24 are connected across each of the lamps 10 and 12, respectively, and a capacitor 26 is connected across the series combination.

The transformer 14 has a primary winding 28 having a center tap 29 which is connected to the output of a DC power supply incorporating a bridge rectifier 30 and a filter-storage capacitor 32. The bridge rectifier 30 is a conventional fullwave rectifier, energized by an AC source connected to lines 34, and adapted to reduce DC across the capacitor 32.

An inverter incorporates a pair of series connected transistors 36 and 38, which extend from one end of the primary winding 28 through a resistor 40 to ground, and a second pair of series connected transistors 42 and 44 which are connected from the other end of the primary winding 28 through the resistor 40 to ground. By operation described below, the two pairs of transistors are rendered conductive alternatively, so that current flows alternately in opposite directions throuh the two halves of the primary winding 28, developing a voltage in the secondary winding 16 which excites and drives the lamps 10 and 12. Normally, the frequency of operation of the inverter is dependent on the resonant frequency of the circuit including the inductor 18 and the capacitors 20, 22, 24 and 26.

A pair of auxiliary windings 46 and 48 are connected to supply base drive to the two pairs of transistors of the inverter. One end of the winding 46 is connected through a resistor 50 to the base of the transistor 36, and from that point through a resistor 52 to the base of the transistor 38. Similarly, one end of the winding 48 is connected through a resistor 54 to the base of the transistor 42, and from that point through a resistor 56 to the base of the transistor 44. These resistors supply biasing current to the bases of the transistors. An additional bias is connected to the base of the transistor 36 by means of a series circuit including a capacitor 58 and a resistor 60, connected to the base from one of the lines 34. This circuit permits a few milliamps to flow from the line to insure start-up oscillation of the inverter.

When the circuit is first turned on (by means of a switch in a line 34 not shown), pulsating DC is applied to the center tap of the primary winding 28, and a small current through the resistor 60 causes the transistors 36 and 38 to conduct. These transistors support a current flow through the primary winding 28 of the transformer 14, thereby inducing the voltage in the secondary winding 16, which causes a current to flow through the series circuit including the lamps 10 and 12. The complete path for this current, starting from ground, includes a diode 62 connected from ground to one end of the winding 16, inductor 18, capacitor 20, lamps 10 and 12, diode 64, resistor 66 and diode 68 to ground. This current produces a positive voltage drop across the circuit including the diodes 64 and 68 and the resistor 66. Connected in parallel with the circuit is a diode 70 and a capacitor 72, which functions to store the peak value of the positive voltage drop, which voltage is connected to the base of the transistor 38 through a resistor 74. Accordingly, additional positive drive is supplied to the transistor 38, which, in turn, increases the drive on the transistor 36. This increases the current flow through the left half of the primary winding 28, and this current flow persists for one-half cycle of oscillation, as determined by the components of the circuit including the lamps 10 and 12. During this half-cycle, the bias supplied to the transistors 42 and 44 by means of the winding 48 maintains these transistors cut off, and the voltage drop across the diode 62, also assists in holding off these transistors. After a half-cycle of operation, the current flow through the series circuit including the lamps 10 and 12 begins to reverse, tending to reverse the polarity of the voltages induced in the windings 46 and 48. This causes the transistor pair 42 and 44 to become conductive, while the transistor pair 36 and 38 are cut off.

With the reverse current in the secondary winding 16 of the transformer 14, positive drive is applied to the transistors 42 and 44 through a circuit which is identical to that which has been described above for the transistors 36 and 38. This current flows from ground through a diode 76, through the lamps 10 and 12, the capacitor 20, and the inductor 18 to one end of the secondary winding 16, and from the other end of the secondary winding, to the feed-back circuit for the transistor pair 42 and 44. A resistor 78, connected from the cathode of the diode 76 to the base of the transistor 38, tends to supply negative bias to the base of the transistor 38, but the application of such negative bias is delayed by the discharge of capacitor 72 through the resistors 74 and 78, which functions to delay the turn-off of the transistor 38 by a time depending on the peak voltage across the capacitor 72, which is proportional to peak current through the secondary circuit. Delaying the turn-off of the transistor 38 tends to reduce the frequency of operation of the apparatus, and from the circuit arrangement illustrated, it is clear that the frequency of operation is reduced for increasing the secondary currents. This brings about a phase shift of the primary current relative to the secondary current, with a result that the effective load of the circuit becomes more reactive for increasing secondary currents, thereby limiting the power dissipation of the apparatus. This operation is particularly significant during periods of operation in which relatively low loads are present in the secondary circuit, such as, for example, the omission of some or all of the lamps from their connected positions.

When the circuit is turned on, the series circuit including the inductor 18 and the capacitor 20 functions as a series resonant circuit, and the voltage and current in the circuit increases during successive half-cycles, until the ignition voltage of the lamps 10 and 12 is reached. Before ignition, the secondary current flows through the filaments 21, 23, 25 and 27 of the lamps 10 and 12, thereby heating the filaments and tending to induce ignition of the lamps 10 and 12. Following ignition, the current flows primarily through the ionized gas within the lamps 10 and 12, since the capacitors 22 and 24 represent a higher impedance. This represents an effective short-circuit across the filament windings, so that the filaments carry current for only short periods of time and the life of the lamps 10 and 12 is thereby greatly extended.

The voltage and current in the series secondary circuit increases with successive half-cycles, until the ignition voltage of the lamps 10 and 12 is reached. The maximum voltage and current is limited, however, by the circuits described above, which reduces the frequency of operation of the inverter for increasing secondary currents, by delaying the turn-off of the transistors 38 and 44. The parameters of the feed-back circuits which result in delaying the turn-off of these transistors can be selected to give a design maximum voltage and current for the secondary circuit, so that the maximum limits of the components of the circuit are not exceeded.

A pair of diodes 80 and 82 are connected from ground to opposite ends of the primary winding 28, to allow power to be returned to the DC supply, and stored in the capacitor 32, through the winding 28 of the transformer 14. These diodes also limit the reverse voltage which can appear across the transistor pairs 36, 38, 42 and 44.

A pair of diodes 84 and 86 are connected in reverse-poled fashion between ground and the common terminal of windings 46 and 48, to maintain the potential at this point different from ground by the drop across one diode in either direction.

It will be apparent that since the secondary circuit is designed to have its voltage and current increase until the lamps 10 and 12 are ignited, additional lamps may be inserted in series in the circuit, without substantial affect on circuit operation. Therefore, the ballast-inverter of the present invention may be used with circuits employing different numbers of series connected lamps. Each additional lamp will be connected in series in the manner of lamps 10 and 12, with their filament windings connected in series with a capacitor similar to the manner shown for the lamps 10 and 12.

Even though the secondary voltage of circuits shown in the drawing can increase to relatively high values, it is apparent from the circuit arrangement shown that the maximum voltage which can appear across each power transistor pair is limited to twice the line voltage. This allows the use of relatively inexpensive power transistors, or the attainment of increased safety factors when transistors having higher limit voltages are employed.

The transistors 36, 38, 42 and 44 are switched on and off when there is no current, or very little current, through them, and therefore the conversion efficiency of the inverter is very high. The current in the secondary circuit is very nearly a sine wave, which tends to reduce RFI to a minimum. The lack of switching transients in the primary circuit also assists in minimizing RFI.

Proper selection of the values for the capacitors 22, 24 and 26 regulates the amount of filament power expended in each lamp during starting. The capacitor 26 assures a complete circuit for the secondary if the lamp circuit should be open circuited. In that event, the primary current and voltage are approximately 90° out of phase with each other, to render the effective load wholly reactive.

The resistor 40 functions to tend to hold off conduction of one transistor pair by a raised potential at the emitter, until the other pair becomes cut off.

Although the windings 46 and 48 are shown as separate windings in the drawing, they may be replaced by a tapped winding, if desired. Alternatively, the common connection of these windings may be connected to a source of reference potential, or to a point having a fraction of the DC supply potential, as determined by a voltage divider or the like.

In an alternative embodiment, a separate transformer winding can be provided on the transformer 14 for powering the filaments of the lamps 10 and 12, in which case the capacitors 22 and 24 are connected across the main terminals of the lamps, and the capacitor 26 may be omitted.

In one embodiment corresponding to that shown in the drawing, the values of certain of the parameters of the circuit components were as follows:

capacitors
20—0.006 μfd
22—1000 Pfd
24—1000 Pfd
26—0.002 μfd
72—0.1 μfd
inductor
18—2 mh
resistors 40—0.5 ohm
66—3.3 ohm
74—47 ohm
78—100 ohm It will be apparent to those skilled in the art that various additions and modifications may be made in the apparatus of the present invention, without departing from the essential features of novelty thereof, which are intended to be defined and secured by the appended claims.

What is claimed is:

1. An electronic ballast-inverter circuit for fluorescent lamps comprising:

a transformer having primary and secondary windings, said secondary winding adapted to be connected in series with a fluorescent lamp, a capacitor, an inductor and a resistor connected in series with said secondary winding, a source of DC connected to a center tap of said primary winding, a transistor connected to one end of said primary winding for selectively drawing current through one-half of said primary winding, and a feed-back circuit including said resistor for biasing said transistor in response to current flowing through said secondary winding.

2. Apparatus according to claim 1, including a pair of transistors, one connected to each end of said primary winding, a second resistor connected in series with said secondary winding, and a feed-back circuit for each of said pair of transistors incorporating the first resistor and second resistor for biasing said transistors oppositely in response to current flowing through said secondary winding in opposite directions.

3. Apparatus according to claim 2, including means for sensing the peak current through said secondary winding, and means for modifying the biasing of said transistors in response to said peak current.

4. Apparatus according to claim 2, including first and second means for sensing the peak current through said secondary winding in respectively opposite directions, means responsive to increased peak current in one direction for extending the duration of bias supplied to one of said transistors.

5. Apparatus according to claim 2, including means for connecting one terminal of said pair of transistors together, and impedance means connecting said terminal to a source of reference potential, whereby current flowing through one of said transistors tends to bias off the other.

6. Apparatus according to claim 2, including a third transistor connected in series with a first transistor of said pair, means connected to said first and third transistors to cause them to operate in synchronism, a fourth transistor connected in series with the second transistor of said pair, and means connected to said second and fourth transistors to cause them to operate in synchronism.

7. Apparatus according to claim 1, wherein said feedback circuit incorporates a first diode in series with said resistor poled in the direction of said secondary current, a second diode and a second resistor, said second diode and resistor being connected to apply the voltage drop across the first resistor and said first diode to the control terminals of said transistor.

8. Apparatus according to claim 1, wherein the DC source includes a rectifier adapted to be connected to an AC power source, and including impedance means connected from said AC source to a control terminal for said transistor.

9. Apparatus according to claim 1, including an additional secondary winding on said transformer, and means for connecting said additional secondary winding for biasing said transistor in response to a change in current flowing through said primary winding.

10. A fluorescent lamp circuit incorporating a plurality of fluorescent lamps connected in a series circuit, each of said lamps having a capacitor connected between one terminal of each of two filament windings at opposite ends of the lamp envelope, the opposite terminals of said filament windings being connected in said series circuit, a first capacitor connected in parallel with said series circuit to form a parallel circuit, an inductor connected in series with said parallel circuit, a transformer having a primary and secondary winding, said secondary winding being connected in series with said inductor, and inverter means connected to said primary winding for supplying AC power to said series circuit through said transformer.

* * * * *